United States Patent [19]

Nishitsuji

[11] Patent Number: 4,808,085

[45] Date of Patent: Feb. 28, 1989

[54] CLOSED TYPE ELECTRIC COMPRESSOR

[75] Inventor: Kazuichi Nishitsuji, Fujinomiya, Japan

[73] Assignee: Kabushiki Kaisha Toshiba, Kawasaki, Japan

[21] Appl. No.: 855,599

[22] Filed: Apr. 25, 1986

[30] Foreign Application Priority Data

Apr. 27, 1985 [JP] Japan ..... 60-63915[U]

[51] Int. Cl.[4] ..... F04B 17/00; F04B 35/00

[52] U.S. Cl. ..... 417/363; 417/902

[58] Field of Search ..... 417/363, 902, 415, 360; 248/573, 560, 674, 300

[56] References Cited

U.S. PATENT DOCUMENTS

| | | | |
|---|---|---|---|
| 2,435,108 | 1/1948 | Touborg | 417/363 |
| 3,606,594 | 9/1971 | Lewis et al. | 417/415 |
| 4,238,172 | 12/1980 | Abe et al. | 417/363 |
| 4,566,865 | 1/1986 | Nishitsuji et al. | 417/902 |

FOREIGN PATENT DOCUMENTS

| | | | |
|---|---|---|---|
| 549206 | 8/1972 | Japan . | |
| 22112 | 2/1977 | Japan | 417/363 |
| 174175 | 10/1983 | Japan | 417/363 |
| 173578 | 10/1984 | Japan | 417/363 |
| 180084 | 10/1984 | Japan | 417/363 |

*Primary Examiner*—Donald E. Stout

*Attorney, Agent, or Firm*—Cushman, Darby & Cushman

[57] ABSTRACT

A closed type electric compressor includes a closed container and a compressor body elastically supported within the container. The body has a support frame supporting a compression section and an electric motor for driving the compression section. The support frame is formed with a pair of engaging holes facing the inner side surface of the container. A pair of stoppers are fixed to the inner side surface of the container and perpendicularly extend therefrom. Each stopper is loosely inserted into the corresponding engaging hole so as to engage the engaging hole to prevent excessive elastic deformation of the compressor body when the compressor receives large shock.

5 Claims, 2 Drawing Sheets

CLOSED TYPE ELECTRIC COMPRESSOR

CROSS REFERENCE TO THE RELATED APPLICATION

U.S. patent application Ser. No. 634,495 entitled "Closed Type Compressor", filed July 26, 1984, and and now U.S. Pat. No. 4,566,865 assigned to the assignee of the present invention, discloses a compressor wherein the compressor body is elastically supported in a closed case.

BACKGROUND OF THE INVENTION

This invention relates to a closed type electric compressor and, in particular, to a closed type electric compressor in which a compressor body is elastically supported within a closed container by means of a spring.

In a compressor of this type, in general, a compressor body is elastically supported within a closed container by means of a spring, thereby preventing vibration and noise of the compressor body from being externally transmitted during an operation. In order to adequately prevent such vibration and noise from being transmitted outside, a pliable spring, i.e., a spring having a smaller spring constant has to be used to support the compression body. If, however, use is made of such a pliable spring, the compressor body will greatly displace and collide against the inner wall of the closed container when a greater shock is applied on, for example, the case while the compressor is being carried. In this case, the component parts of the compressor body may be damaged or the accuracy with which the compressor body is assembled will be lowered.

SUMMARY OF THE INVENTION

It is accordingly the object of this invention to provide a closed type electric assembly which can prevent the compressor body from colliding against the inner surface of its outer container due to a greater displacement of the compressor body as discussed above.

In a compressor according to this invention, a compressor body includes a frame having an engaging hole therein and the outer container has a stopper extending from its inner surface into the engaging hole of the frame, so that when the compressor body is greatly displaced the stopper engages the engaging hole to prevent the compressor body from contacting the side of the container.

BRIEF DESCRIPTION OF THE DRAWINGS

FIGS. 1 to 4 show a closed type electric compressor according to an embodiment of the invention, in which FIG. 1 is a sectional view of the compressor, FIG. 2 is an expanded view of a support frame, FIG. 3 is a perspective view showing the support frame, and FIG. 4 is a sectional view taken along line IV-IV in FIG. 1.

DETAILED DESCRIPTION OF THE PREFERRED EMBODIMENT

An embodiment of the present invention will now be described in detail with reference to the accompanying drawings.

Figure 1:
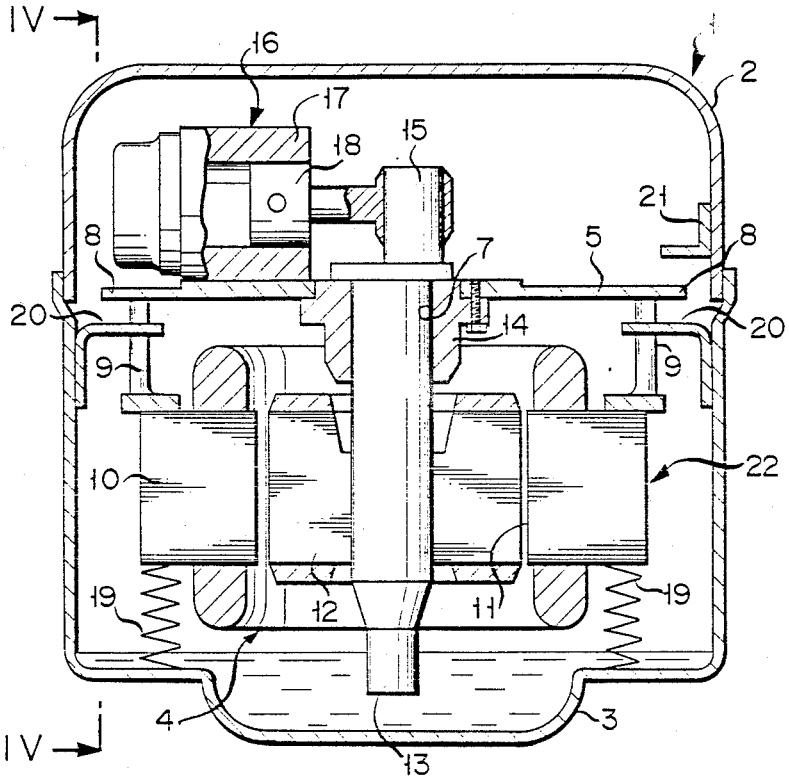

As shown in FIG. 1, a closed type electric compressor includes closed container 1 having upper and lower cases 2 and 3 jointed to each other. Compressor body 4 having support frame 5 is housed within container 1.

Figure 2:
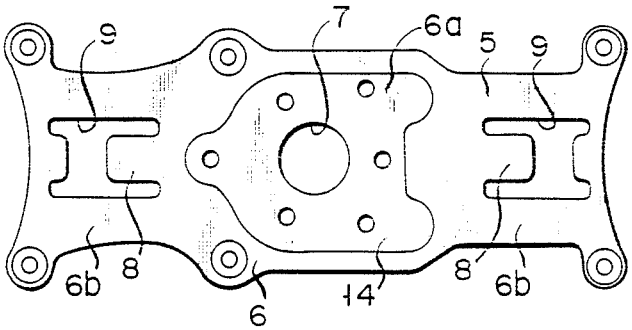
Figure 3:
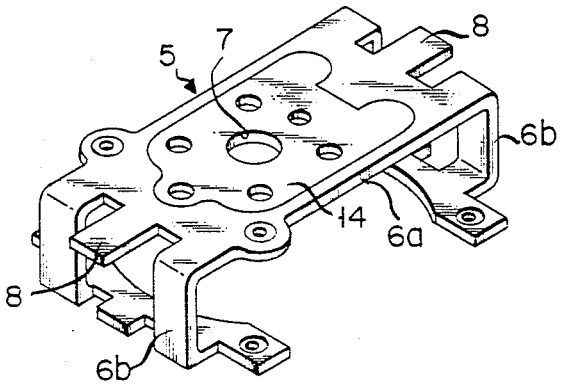

Support frame 5 is formed by bending both end portions of plate member 6 (see FIG. 2) as shown in FIG. 3. Bearing 14 having mounting hole 7 is fixed to a central area, i.e. flat section 6*a* of plate member 6, as viewed in a longitudinal direction. A pair of substantially H-like engaging holes 9 are formed one at each end portion 6*b* of plate member 6. The end portions of plate member 6 are bent in a substantially U-shaped configuration, taken into consideration the length of a pair of engaging holes 9. The engaging holes 9 extend in a vertical direction such that they are located opposite to each other with projections 8 outwardly extending from the upper ends of engaging holes 9.

Rotating shaft 13 is rotatably inserted into mounting hole 7 and extends downward from support frame 5. Annular stator 10 is fixed to the bent end portions of support frame 5 to be coaxial with rotating shaft 13. Rotor 12 is fitted to rotating shaft 13 and located in inner cavity 11 of stator 10. Crank shaft 15 is provided at the upper end of rotating shaft 13. Cylinder 17 of compression section 16 is fixed to the upper surface of support frame 5. Piston 18 is slidably received within the cylinder and connected to crank shaft 15. When shaft 13 is rotated to permit crank shaft 15 to be eccentrically rotated, then piston 18 is reciprocated to cause air to be compressed within cylinder 17. That is, stator 10 and rotor 12 constitute electric motor 22 for driving compression section 16.

Compressor body 4 having above construction is elastically supported by a plurality of springs 19, for example, four springs disposed between the lower surface of stator 10 and the inner bottom of container 1. Each spring 19 is free to expand and contract in a direction parallel to shaft 13. Within closed container 1, support frame 5 is located parallel to the inner bottom surface of lower case 3 and the engaging holes 9 are located opposite to the side wall of lower case 3.

Figure 4:
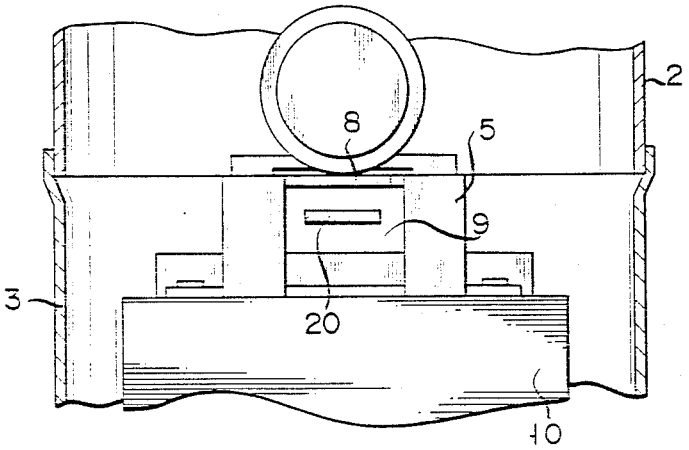

A pair of first stoppers 20 with an L-shaped cross-section are fixed to the inner side surface of lower case 3 at portions facing engaging holes 9, respectively. The respective stopper 20 extends from the inner side surface in a direction substantially perpendicular thereto and is loosely inserted in the corresponding engaging hole 9 of plate member 6. As seen from FIG. 4, the respective stopper is located in engaging hole 9 and can move in the horizontal and vertical directions. A second stopper 21 is fixed to the inner side surface of the upper case 2 and located above one projection 8 to face it.

As shown in FIG. 1 lubrication oil may be held in the bottom of container 1.

In the compressor of this embodiment, since compressor body 4 is elastically supported by springs 19 within container 1, the vibration of compressor body 4 during the operation of the compressor is absorbed, thus preventing vibration and noise from being transmitted outside of container 1. If, for example, a greater shock acts upon closed container 1 during transmission, then compressor body 4 supported by springs 19 tends to displace to a greater extent. According to this embodiment, however, any excessive displacement of compressor body 4 is restricted by first and second stoppers 20 and 21. That is, the downward movement of compressor body 4 is restricted through the abutment of the upper edges of engaging holes 9 against first stoppers 20 and the upward movement of compressor body 4 is restricted through the abutment of projection 8 against second stopper 21. The horizontal movement of body 4 is restricted through the abutment of the side edges of engaging holes 9 against first stoppers 20. The horizontal movement of body 4, and left/right movement thereof in particular in FIG. 1, is restricted through the abutment of the ends of projections 8 against the inner surface of container 1. Since any excessive up/down, horizontal or combined movement of compressor body 4 is restricted by first and second stoppers 20 and 21, it is possible to prevent compressor body 4 from crashing against the inner surface of container 1. Thus there is no possibility that compressor body 4 will be damaged or the compressor will be reduced in assembling accuracy.

This invention is not limited to the aforementioned embodiment and various changes and modifications can be made within the spirit and scope of this invention. For example, the stopper is not limited to an L or plate-like configuration and can be varied as required. Although in the above embodiment the upward movement of the compressor body is restricted by the second stopper, such a movement may be restricted through the abutment of the lower edge of engaging hole 9 against the first stopper. Since the upward displacement of the compressor body is relatively small, no particular restriction may be imparted to such upward displacement. Engaging hole 9 is not limited to a rectangular configuration but may be another configuration, for example, a circular configuration. Compressor section 16 may be not only of a reciprocating type but also a rotary type.

What is claimed is:

1. A closed type electric compressor comprising:

a closed container;

a compressor body disposed within the closed container and having a support frame, compression means mounted on the support frame, and drive means for driving the compression means, said support frame having a flat section for supporting said compression means and drive means, and a pair of end portions which are located substantially perpendicular to the flat section, on each side thereof, each of said end portions having an engaging hole;

support means for elastically supporting the compression body within the closed container; and a pair of first stoppers fixed to the closed container and loosely inserted into the engaging holes, respectively, for engaging the engaging holes to prevent excessive horizontal and vertical movement of said support frame relative to said closed container when the compressor receives a large shock, whereby said elastic support means, said compressor body, and said closed container are protected from damage that might otherwise result from such a shock.

2. The compressor according to claim 1, wherein said closed container has an inner side surface facing the end portions of the frame in a spaced-apart relation, and each of said first stoppers extends from the inner side surface of the closed container into the corresponding engaging hole.

3. The compressor according to claim 2, wherein said support frame has a pair of projections, each of said projections being located proximate to the corresponding engaging hole and extending from the flat section of said support frame toward the inner side surface of said closed container.

4. The compressor according to claim 3, which further comprises at least one second stopper fixed to the inner side surface of said closed container to be engageable with one of said projections, said second stopper being spaced from and substantially parallel to at least one of said first stoppers respectively, with said one projection being interposed therebetween.

5. The compressor according to claim 1, wherein said support means includes a plurality of springs expandable in a direction perpendicular to said flat section of said support frame.

* * * * *